US005554449A

United States Patent [19]

Tonomura et al.

[11] Patent Number: 5,554,449

[45] Date of Patent: Sep. 10, 1996

[54] HIGH LUMINANCE THIN-FILM ELECTROLUMINESCENT DEVICE

[75] Inventors: Shoichiro Tonomura; Masahiro Matsui; Takashi Morishita, all of Fuji, Japan

[73] Assignee: Asahi Kasei Kogyo Kabushiki Kaisha, Japan

[21] Appl. No.: 343,999

[22] Filed: Nov. 18, 1994

Related U.S. Application Data

[63] Continuation of Ser. No. 913,988, Jul. 17, 1992, abandoned, which is a continuation of Ser. No. 760,855, Sep. 18, 1991, abandoned, which is a continuation of Ser. No. 492,748, Mar. 13, 1990, abandoned.

[30] Foreign Application Priority Data

Mar. 15, 1989 [JP] Japan ..... 1-60699
Dec. 26, 1989 [JP] Japan ..... 1-334743

[51] Int. Cl.[6] ..... H05B 33/02

[52] U.S. Cl. ..... 428/690; 428/691; 428/917; 313/506; 313/503; 313/509; 427/157; 427/66; 427/255.2; 427/255.3

[58] Field of Search ..... 156/611, 612; 118/49; 313/506, 503, 509; 427/87, 248 B, 248 E, 248 J, 255 J, 157; 428/690, 691, 917

[56] References Cited

U.S. PATENT DOCUMENTS 4,751,427 6/1988 Barrow et al. ..... 313/503
4,777,099 10/1988 Mimura et al. ..... 428/690

FOREIGN PATENT DOCUMENTS

3630983A1 3/1987 Germany .
63-46117 9/1988 Japan .

OTHER PUBLICATIONS

Inoguchi et al., "Stable High–Brightness Thin–Film Electroluminescent Panels", p. 84 (1974).
Russ et al., "The Effects of Double Insulating Layers on the Electrolumnesece if Evaporated ZnS:Mn Films", p. 1066 (1967).
"Fabrication and Characterization of CaS and SrS Multi–Color Electroluminescent Thin Film Devices", p. 991 (1986).
"Red and Blue Electroluminescence and Alkaline–Earth Sulfide Thin–Film Devices", p. 29 (1986).
"Oxygen Contamination in SrS:Ce Thin–Film Electroluminescent Device", p. L1923 (1988).

*Primary Examiner*—Charles R. Nold
*Attorney, Agent, or Firm*—Finnegan, Henderson, Farabow, Garrett & Dunner

[57] ABSTRACT

A high luminance thin-film electroluminescent device comprising a phosphor layer comprising SrS as the host material and a luminous center. The phosphor layer is sandwiched between two insulating layers and two thin-film electrodes are provided on each side of the insulating layers. At least one of the electrodes is transparent, and the excitation spectrum of the phosphor layer exhibits a peak having a maximum value at a wavelength of about from 350 nm to 370 nm. Such a high luminance thin-film electroluminescent device can be prepared by annealing its phosphor layer comprising SrS as the host material at a temperature of at least 650 ° C. for at least one hour in an atmosphere of a sulfur-containing gas.

19 Claims, 3 Drawing Sheets

HIGH LUMINANCE THIN-FILM ELECTROLUMINESCENT DEVICE

This application is a continuation of application Ser. No. 07/913,988 filed Jul. 17, 1992, now abandoned, which is a continuation of Ser. No. 07/760,855 filed Sep. 18, 1991, now abandoned, which is a continuation of Ser. No. 07/492,748 filed Mar. 13, 1990 now abandoned.

FIELD OF THE INVENTION

The present invention relates to an electroluminescent device (hereinafter referred to as "EL device") which gives emission according to the voltage applied. More specifically, it relates to a high luminance thin-film EL device of a double insulating structure whose phosphor layer comprises SrS as the host material and a method for preparing such an EL device.

BACKGROUND OF THE INVENTION

There is a phenomenon whereby electroluminescent emission is obtained by applying a high voltage to a compound semiconductor such as ZnS and ZnSe doped with a luminous center such as Mn. Recently, by the development of thin-film EL devices of a double insulating structure, luminance and life have been rapidly improved as described in SID 74 Digest of Technical Papers p. 84, 1974 and Journal of Electrochemical Society, 114, 1066 (1967), and such thin-film EL devices are employed for flat panel displays which are now commercially available.

The emission color of the EL devices is determined by the combination of a semiconductor host material constituting a phosphor layer and a luminous center. For example, the ZnS:Mn phosphor layer in which ZnS is a host material and Mn is a luminous center exhibits a yellow-orange electroluminescent emission (hereinafter referred to as "EL emission") and the ZnS:Tb phosphor layer exhibits a green EL emission. For the preparation of full color thin-film displays with EL devices, there are EL devices which emit the three primary colors, i.e., red, blue and green. High luminance red, blue or green emitting EL devices have been investigated. With regard to the blue color, it is known that blue EL emission can be obtained from a ZnS:Tm phosphor layer and a SrS:Ce phosphor layer as in Japanese Patent Publication (Kokoku) No. 46117/1988 and Hiroshi Kobayashi, THE JOURNAL OF THE INSTITUTE OF TELEVISION ENGINEERS OF JAPAN, 40, 991 (1986).

However, the luminance of these EL devices is not sufficient, and of these EL devices the luminance of the blue EL devices is particularly low. According to Japanese Patent Publication (Kokoku) No. 46117/1988, a luminance of about 100 fL (350 cd/m$^2$) with 2.5 kHz drive frequency is obtained with an EL device having a SrS:Ce phosphor which has been prepared by electron beam evaporation and has been annealed at 600° C. for 30 minutes in a hydrogen sulfide atmosphere. According to SID 86 Digest of Technical Papers, p. 29, 1986, a maximum luminance of 1600 cd/m$^2$ with 5 kHz drive frequency is attained with the EL device having a SrS:Ce phosphor layer which has been prepared by the electron beam evaporation in a sulfur atmosphere, and this luminance value is the highest so far obtained. For practical purposes, however, this value is still very low and the conditions for preparing high luminance EL devices have been investigated. For example, phosphor layers having high crystallinity can be prepared by molecular beam epitaxy (MBE) or metal organic chemical vapor deposition (MOCVD), and by these methods a considerably high luminance is obtained with the yellow-orange emitting EL device having a ZnS:Mn phosphor layer. But as for the blue emitting EL device having a SrS:Ce phosphor layer, a high luminance has not been obtained.

In the present invention, it has been found that when the phosphor layer of high luminance EL devices having a phosphor layer comprising SrS as the host material is annealed at a temperature of at least 650° C. for at least one hour in an atmosphere of a sulfur-containing gas, the phosphor layer exhibits a characteristic peak in the neighborhood of a wavelength 360 nm in the excitation spectrum and the EL device having such an annealed phosphor layer shows a high luminance.

SUMMARY OF THE INVENTION

An object of the present invention is to provide a high luminance thin-film EL device of a double insulating structure.

Another object of the present invention is to provide a method for preparing such an EL device.

According to the present invention there is provided a thin-film EL device which comprises a phosphor layer comprising SrS as the host material and a luminous center, said phosphor layer being sandwiched between two insulating layers and two thin-film electrodes for applying a voltage being provided on each side of the insulating layers, wherein one of the said electrodes is transparent, and wherein the excitation spectrum of phosphor layer exhibits a peak having a maximum value at a wavelength of about from 350 nm to 370 nm and a method for preparing a thin-film EL device which comprises the steps of:

(a) forming a thin-film electrode for applying a voltage on a substrate;

(b) forming an insulating layer on the electrode;

(c) forming a phosphor layer comprising SrS as the host material and a luminous center on the insulating layer;

(d) annealing the phosphor layer at a temperature of at least 650° C. for at least one hour in an atmosphere of a sulfur-containing gas;

(e) forming an insulating layer on the annealed phosphor layer;

(f) forming a thin-film electrode for applying a voltage; and at least one of the electrodes in steps (a) and (f) being transparent.

DETAILED DESCRIPTION OF PREFERRED EMBODIMENTS

Figure 1:
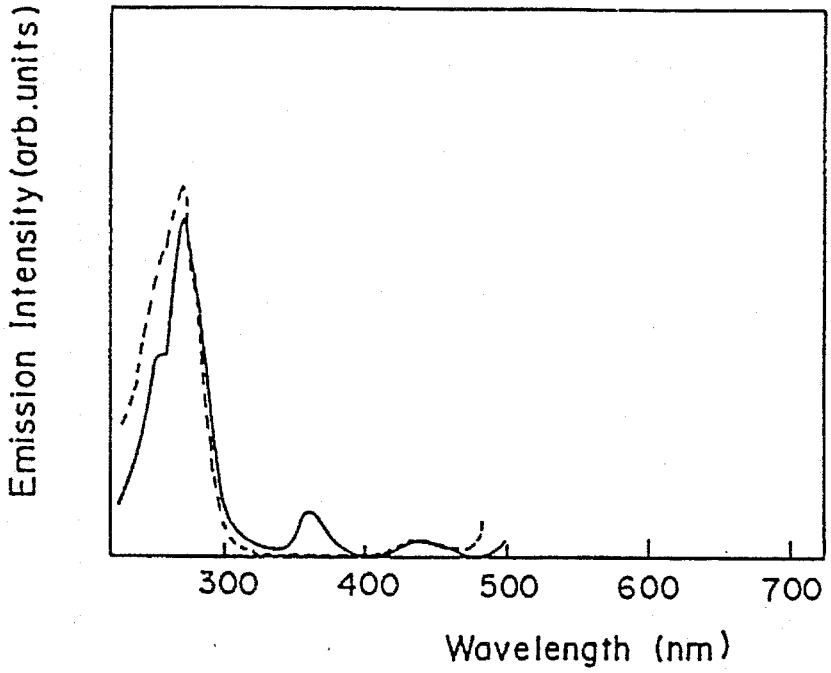
FIG. 1 shows excitation spectra of a thin-film EL device having a SrS:Ce phosphor layer of the present invention as a solid line and a conventional thin-film EL device having a SrS:Ce phosphor layer as a dashed line.

The host material of the phosphor layer of the present invention is SrS. The SrS is doped with a luminous center and the luminous center is not particularly limited. Exemplary luminous centers which can be employed in the present invention include but are not limited to Mn, Tb, Tm, Sm, Ce, Eu, Pr, Nd, Dy, Ho, Er, Cu and any mixtures thereof. Of these luminous centers, Ce is preferred. The luminous center may be in the form of the metal as described above or in the form of a compound such as a halide and a sulfide including $CeF_3$, $CeCl_3$, $CeI_3$, $CeBr_3$ and $Ce_2S_3$; $EuF_3$, $EuCl_3$, $EuI_3$, $EuBr_3$ and $Eu_2S_3$; $PrF_3$, $PrCl_3$, $PrI_3$, $PrBr_3$ and $Pr_2S_3$; $TmF_3$, $TmCl_3$, $TmI_3$, $TmBr_3$ and $Tm_2S_3$; $SmF_3$, $SmCl_3$, $SmI_3$, $SmBr_3$ and $Sm_2S_3$; $NdF_3$, $NdCl_3$, $NdI_3$, $NdBr_3$ and $Nd_2S_3$; $DyF_3$, $DyCl_3$, $DyI_3$, $DyBr_3$ and $Dy_2S_3$; $HoF_3$, $HoCl_3$, $HoI_3$, $HoBr_3$ and $Ho_2S_3$; $ErF_3$, $ErCl_3$, $ErI_3$, $ErBr_3$ and $Er_2S_3$; $TbF_3$, $TbCl_3$, $TbI_3$, $TbBr_3$ and $Tb_2S_3$; $MnFl_2$, $MnCl_2$, $MnI_2$, $MnBr_2$ and MnS; CuF, $CuF_2$, CuCl, $CuCl_2$, CuI, $CuI_2$, CuBr, $CuBr_2$, $Cu_2S$ and CuS.

The concentration of the luminous center is not particularly limited, but when it is too low, increases in luminance are limited. On the other hand, when the concentration of the luminous center is too high, luminance does not increase due to decrease in the crystallinity of the phosphor layer and due to concentration quenching. Thus, the concentration of the luminous center which can be employed in the present invention is preferably about from 0.01 mol % to 5 mol % and more preferably about from 0.05 mol % to 2 mol % per mol of SrS as the host material.

Furthermore, when the phosphor layer is used together with a charge compensator, the EL device gives a higher luminance than an EL devices in which the phosphor layer does not contain the charge compensator. The charge compensator compensates divalent SrS for its electric charge when a trivalent luminous center such as Ce is added to the SrS host material. Examples of such charge compensators include KCl, NaCl and NaF. The concentration of the charge compensator which can be employed in the present invention is preferably about from 0.01 mol % to 5 mol % and more preferably about from 0.05 mol % to 2 mol % per mol of SrS as the host material.

The thickness of the phosphor layer is not particularly limited but when it is too thin, the luminance is low and when it is too thick, the threshold voltage becomes high. Thus, the thickness of the phosphor layer which is employed in the present invention is preferably about from 500 Å to 30,000 Å and more preferably about from 1,000 Å to 15,000 Å.

The phosphor layer comprising SrS as the host material and a luminous center of the present invention can be formed by methods such as sputtering, electron beam evaporation (EB), electron beam evaporation with sulfur coevaporation, MBE and MOCVD. Of these methods, sputtering in an atmosphere of hydrogen sulfide and electron beam evaporation in an atmosphere of sulfur are preferred for forming a phosphor layer which gives an EL device which can emit high luminance, and the sputtering is particularly preferred for easily forming a trap level in the phosphor layer.

Figure 2:
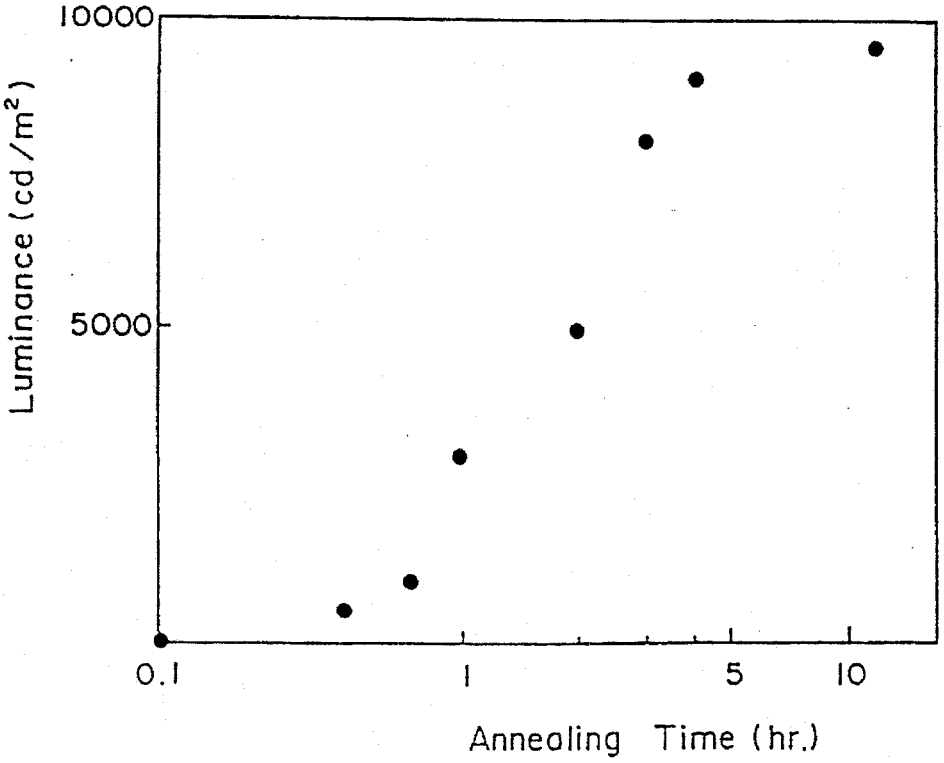
FIG. 2 shows luminance-annealing time characteristics of one embodiment of the SrS:Ce phosphor layer of the present invention.

To obtain the EL device of the present invention, it is necessary to anneal the phosphor layer for at least one hour in an atmosphere of a sulfur-containing gas. FIG. 2 shows luminance-annealing tithe characteristics at an annealing temperature of 700° C. in an argon gas containing 10 mol % of $H_2S$ with 5 kHz sine wave drive. The luminance rapidly-increases with periods of annealing time of one hour or more.

The period of annealing time varies depending on the annealing temperature employed, but the period of annealing time is preferably 2 hours or more, and more preferably 3 hours or more. Even when the annealing is conducted more than 24 hours, the increase in luminance is saturated.

The sulfur-containing gas which is employed in the annealing of the phosphor layer of the EL device of this invention is not particularly limited. Exemplary sulfur-containing gases include but are not limited to hydrogen sulfide, carbon disulfide, sulfur vapor, dialkyl sulfides such as dimethyl sulfide, diethyl sulfide and methyl ethyl sulfide, thiophene and mercaptans such as ethyl methyl mercaptan and dimethyl mercaptan. Of these sulfur-containing gases, hydrogen sulfide is preferred for improving the luminance of the EL device of this invention. It may be assumed that removal of a minute amount of oxygen is greatly effected by hydrogen generated by partial decomposition of hydrogen sulfide with heat.

It is necessary that the annealing temperature is at least 650° C. and preferably the annealing temperature is from 650° C. to 850° C., and more preferably it is from 700° C. to 850° C. for obtaining a remarkable effect with the sulfur-containing gas. When the annealing temperature is below 650° C., the effect of the sulfur-containing gas is small and the luminance of the EL device is only slightly higher than that of the EL device prepared by annealing the phosphor layer in a vacuum or in an inert gas such as argon gas and helium gas. On the other hand, when the annealing temperature is above 850° C., deterioration of the transparent electrode or electrodes and lowering in breakdown voltage of the EL device are disadvantageously brought about.

The concentration of the sulfur-containing gas in the atmosphere of a sulfur-containing gas is not particularly limited and is preferably about from 0.01 mol % to 100 mol % of the entire gas, more preferably about from 0.1 mol % to 30 mol %. An inert gas such as argon and helium is employed as the diluting gas. When the concentration of the sulfur-containing gas is less than 0.01 mol %, its effect is small and concentrations of the sulfur-containing gas of more than 30 mol % tend to saturate its effect.

The excitation spectrum in the present invention means an excitation spectrum of photoluminescence and is a spectrum recording the luminance intensity of the monitoring light when an excitation wavelength is varied by using a peak wavelength of photoluminescence as the monitoring light. FIG. 1 shows the excitation spectra of the phosphor layers comprising SrS as the host material and Ce as the luminous center of the EL device of the present invention as a solid line and the conventional EL device as a dashed line. The phosphor layer of the conventional EL device has a peak at a wavelength of 270 nm corresponding to the energy gap and a peak at a wavelength of 440 nm corresponding to the excitation energy of Ce in the excitation spectrum. On the other hand, the phosphor layer of the EL device of the present invention has, in addition to the above described two peaks, a peak in the neighborhood of a wavelength of 360 nm in the excitation spectrum. This peak wavelength may vary to a small extent depending on the conditions for preparing the phosphor layer, and is preferably about from 350 nm to 370 nm, and more preferably about from 355 nm to 365 nm.

Since the excitation spectrum of the phosphor layer having been annealed at a temperature of at least 650° C. for at least one hour in an atmosphere of a sulfur-containing gas has a peak in the neighborhood of a wavelength of 360 nm, the phosphor layer has an electron trap level (hereinafter referred to as "trap level") at the position of 3.4 eV above the valence band or at the position of 3.4 eV above a level existing within 1 eV from the valence band. The reason why the presence of this trap level increases luminance is not fully understood. Not wishing to be bound by theory, it may be that the trap level exists at a position near the excitation level of $Ce^{3+}$ from the viewpoint of energy levels to interact with each other. This results in a decrease in deactivation of the excitation based on nonradiative energy transfer and increase in luminous efficiency. The peak in the neighborhood of a wavelength of 360 nm does not appear when the phosphor layer is annealed in argon gas or at a temperature below 650° C. for less than one hour, and the conventional EL device having a phosphor layer annealed under such conditions does not emit high luminance.

The annealing of the phosphor layer in an atmosphere of a sulfur-containing gas can produce a film of SrS as the host material having high crystallinity with a small amount of S defects and the half widths of the (220) and (200) lines of the X-ray diffraction pattern of the phosphor layer are less than or equal to 0.5 degrees and less than or equal to 0.4 degrees, respectively.

The phosphor layer prepared by the sputtering in an atmosphere of hydrogen sulfide and the subsequent annealing in an atmosphere of a sulfur-containing has a (220) line as the highest line in the X-ray diffraction patterns and that prepared by the sputtering in an atmosphere of argon, that is, in an atmosphere which does not contain hydrogen sulfide, and the subsequent annealing in an atmosphere of a sulfur-containing gas has a (200) line as the highest line in the X-ray diffraction patterns. The phosphor layer of the present invention preferably has at least one of the (220) line and the (200) line.

In one embodiment of the present invention, the EL device comprising SrS as the host material and Ce as the luminous center exhibits a luminance of 10,000 cd/$m^2$ which is 6 times as high as the luminance having been conventionally attained, and the threshold voltage of the EL device shifts to a lower voltage by 100 V compared to that of the conventional EL device whose phosphor layer is annealed in a vacuum or in an inert gas such as argon.

The emission color of the EL device of one embodiment of the present invention whose phosphor layer comprises SrS as the host material and Ce as the luminous center is rather greenish compared to the conventional EL device whose phosphor layer is annealed in an inert gas such as argon. It has been found from the measurement of the emission spectrum that the peak wavelength of the EL of this embodiment of the present invention shifts to a longer wavelength by about from 10 nm to 20 nm compared to that of the conventional EL. However, the emission color relates to the concentrations of the luminous center, the charge compensator and the sulfur-containing gas in the annealing of the phosphor layer, and by varying these conditions there can be obtained the conventional blue emission color.

Furthermore, because an EL device emitting high luminance can be obtained by annealing the phosphor layer in a sulfur-containing gas, it is believed that the sulfur-containing gas effects removal of a minute amount of oxygen present in the phosphor layer and the annealing atmosphere since the presence of a minute amount of oxygen in the phosphor layer comprising SrS as the host material and Ce as the luminous center causes lowering in luminance as reported in JAPANESE JOURNAL OF APPLIED PHYSICS, 27, L 1923 (1988). Thus, removal of the minute amount of oxygen is desired.

The insulating layer of the EL of the present invention is not particularly limited and is preferably a layer of at least one member selected from the group consisting of $SiO_2$, $Y_2O_3$, $TiO_2$, $Al_2O_3$, $HfO_2$, $Ta_2O_5$, $BaTa_2O_5$, $SrTiO_3$, $PbTiO_3$, $Si_3N_4$ and $ZrO_2$ and the insulating layer may preferably be a plurality of layers of such a metal oxide and a metal nitride.

The thickness of the insulating layer is not particularly limited and is preferably about from 500 Å to 30,000 Å and more preferably about from 1,000 Å to 15,000 Å.

In order to prevent the reaction between the insulating layer and the phosphor layer in forming the layers and in the annealing of the phosphor layer, it is preferred that a metal sulfide layer is provided as the buffer layer between the insulating layer and the phosphor layer. The metal sulfide layer is not particularly limited and exemplary metal sulfides include but are not limited to ZnS, CdS, SrS, CaS, BaS and CuS.

The thickness of the metal sulfide layer is not particularly limited, and is preferably about from 100 Å to 10,000 Å and more preferably about from 500 Å to 3,000 Å.

In the present invention at least one of the two thin-film electrodes for applying a voltage is transparent and the transparent electrode Which can be employed in the present invention is preferably indium tin oxide (ITO), zinc oxide or tin oxide, and the thickness of the transparent electrode is preferably about from 500 Å to 10,000 Å.

The other thin-film electrode for applying a voltage which can be employed in the present invention is preferably Al, Au, Pt, Mo, W or Cr, and the thickness of the electrode is preferably around 2,000 Å.

The transparent thin-film electrode for applying a voltage, the other thin-film electrode for applying a voltage, the insulating layer and the metal sulfide layer of the present invention can also be formed by methods such as reactive sputtering evaporation, sputtering evaporation and vacuum evaporation.

The thin-film EL device of the present invention is prepared by succesively forming a transparent thin-film electrode on a substrate such as a glass or quartz sheet or plate having a thickness of around 1 mm, an insulating layer on the transparent electrode and a phosphor layer on the insulating layer, annealing the phosphor layer thus formed at a temperture of at least 650° C. for at least one hour in an atmosphere of a sulfur-containing gas, and successively forming another insulating layer on the annealed phosphor layer, and another thin-film electrode which may or may not be transparent on the insulating layer. It is preferred that a metal sulfide layer be provided between the insulating layer and the phosphor layer.

When part of the transparent thin-film electrode, e.g., an ITO transparent electrode is not covered with the insulating layer and the phosphor layer, or with the insulating layer, the metal sulfide layer and the phosphor layer, the exposed part of the transparent thin-film electrode becomes electrically insulative due to the contact with the sulfur-containing gas in annealing the phosphor layer in the atmosphere of the sulfur-containing gas. According to the present invention, this problem has been solved by covering the surface of the transparent thin-film electrode at the side of the insulating layer with the insulating layer and the phosphor layer or with the insulating layer, the metal sulfide layer and the phosphor layer, removing parts of the insulating layer and the phosphor layer or the insulating layer, the metal sulfide layer and the phosphor layer after annealing the phosphor layer at a temperature of at least 650° C. for at least one hour in the atmosphere of the sulfur-containing gas to expose part of the transparent thin-film electrode and connecting the exposed part of the transparent thin-film electrode with a lead for the application of a voltage. Also, the uncovered part of the transparent thin-film electrode can be covered with a conductive layer such as Au which prevents permeation of the sulfur-containing gas. It is also possible to form the insulating layer and the phosphor layer or the insulating layer, the metal sulfide layer and the phosphor layer on a thin-film electrode such as Pt, Au, $MoSi_2$, $Mo_2Si_3$, $WSi_2$ and $W_2Si_3$ which have resistance to the sulfur-containing gas before the annealing at a temperature of at least 650° C. for at least one hour in the atmosphere of the sulfur-containing gas, and then the insulating layer or the metal sulfide layer and the insulating layer, and lastly the transparent thin-film electrode on the insulating layer.

The following examples illustrate the present invention in more detail. However, they are given by way of guidance and do not imply any limitations.

The excitation spectrum of the phosphor layer of the thin-film EL devices was recorded by measuring the luminance intensity of the monitoring light by a fluorescence spectrophotometer ("Fluorescence Spectrophotometer F-3000", manufactured by Hitachi, Ltd.), when the excitation wavelength was varied by using the peak wavelength of the photoluminescence of the phosphor layer as the monitoring light.

The maximum luminance of the thin-film electroluminescent device was observed with 5 kHz sine wave drive.

EXAMPLE 1 AND COMPARATIVE EXAMPLE 1

An ITO (indium tin oxide) transparent electrode having a thickness of 1,000 Å was formed by reactive sputtering on a glass substrate ("NA-40", product by Hoya Co., Ltd.). Then a layer of $Ta_2O_5$ having a thickness of 4,000 Å and a layer of $SiO_2$ having a thickness of 1,000 Å were successively formed on the electrode as the insulating layer, respectively, by reactive sputtering evaporation in a mixed gas of 30 mol % of oxygen and 70 mol % of argon. Subsequently, on the insulating layer thus formed was formed a buffer layer of ZnS having a thickness of 1,000 Å by sputtering evaporation in argon gas with a ZnS target. Then a phosphor layer having a thickness of 6,000 Å was prepared on the buffer layer by sputtering evaporation with a pressed target of mixed powder of SrS, 0.3 mol % of $CeF_3$, and 0.3 mol % of KCl per mol of SrS at a substrate temperature of 250° C. while introducing an argon gas containing 2 mol % of hydrogen sulfide at a pressure of 30 mTorr.

Figure 3:
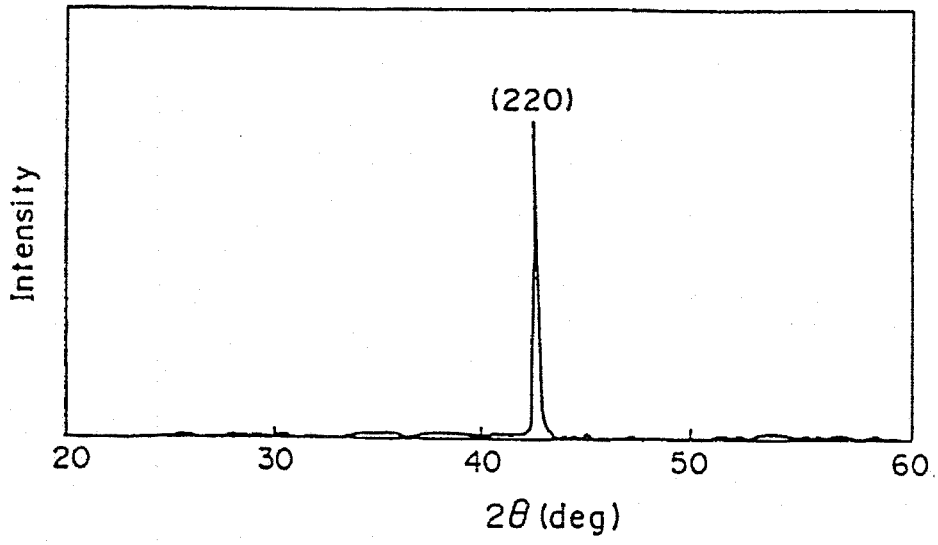
FIG. 3 shows an X-ray diffraction pattern of one embodiment of the SrS:Ce phosphor layers of the present invention.

The phosphor layer thus obtained was annealed at 720° C. for 4 hours in an argon gas containing 10 mol % of hydrogen sulfide. The X-ray diffraction pattern of the annealed phosphor layer which is shown in FIG. 3, exhibited a (220) orientation. The intensity of the peak was remarkably strong compared to that of the phosphor layer annealed in only argon gas. Furthermore, the half width of the peak at the (220) line was 0.4 degree and the excitation spectrum of the annealed phosphor layer which is shown by a solid line in FIG. 1 exhibited a characteristic peak at a wavelength of 360 nm.

Then on the annealed phosphor layer were successively formed a buffer layer of ZnS having a thickness of 1,000 Å, a layer of $SiO_2$ having a thickness of 1,000 Å and a layer of $Ta_2O_5$ having a thickness of 4,000 Å as the insulating layers by sputtering evaporation in the same manner as described above. Subsequently, an aluminum electrode having a thickness of 2,000 Å was prepared on the insulating layer formed. The ITO transparent electrode was exposed by peeling off parts of the phosphor layer and the insulating layer to give a thin-film EL device.

Figure 4:
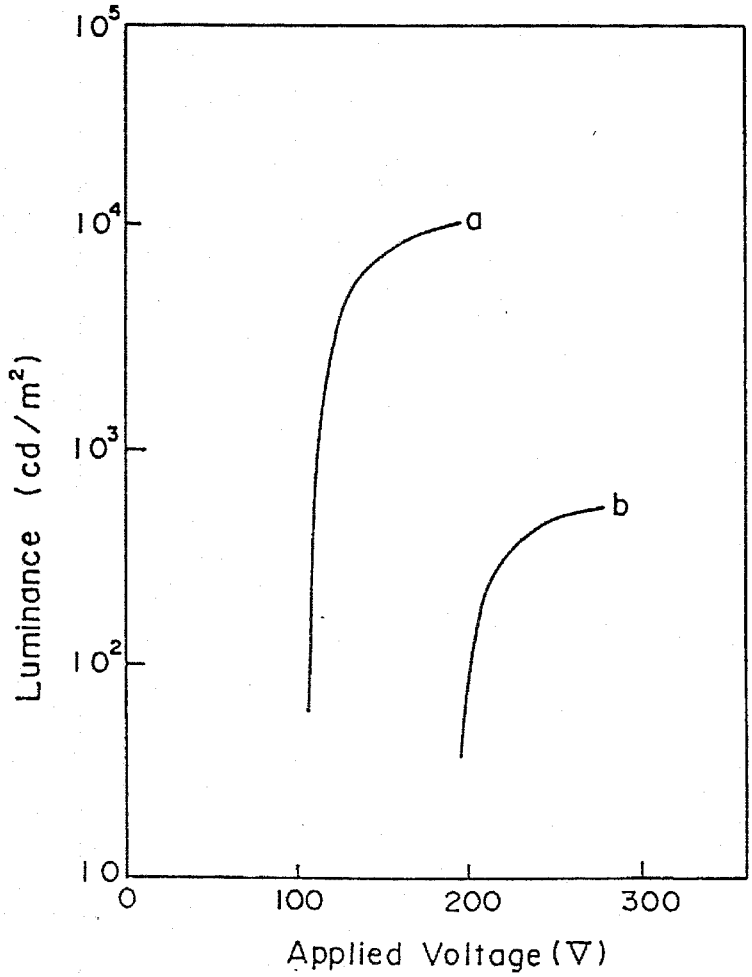
FIG. 4 shows luminance-applied Voltage characteristics of one embodiment of the EL devices having a SrS:Ce phosphor layer of the present invention (curve a) and of one conventional EL device having a SrS:Ce phosphor layer (curve b).

The luminance-applied voltage characteristics of the thin-film EL device thus obtained are shown as a in FIG. 4. The maximum luminance reached 10,000 cd/m$^2$ which was six times as high as that so far obtained.

The above described procedure for preparing a thin-film EL device was repeated except that the annealing of the phosphor layer was carried out in only argon gas.

The luminance-applied voltage characteristics of the thin-film EL device thus obtained is shown as b in FIG. 4 and the maximum luminance was 500 cd/m$^2$ and the threshold voltage shifted to a higher voltage by 100 V. Furthermore, the excitation spectrum of the phosphor layer which is shown by a dashed line in FIG. 1 did not exhibit the peak in the neighborhood of a wavelength of 360 nm.

COMPARATIVE EXAMPLE 2

The procedure of Example 1 for preparing a thin-film FL device was repeated except that the annealing of the phosphor layer was carried out in a nitrogen gas atmosphere containing 5 mol % of hydrogen sulfide at 600° C. for 30 minutes.

The excitation spectrum of the phosphor layer of the thin-film EL device thus prepared did not exhibit the presence of a peak in the neighborhood of a wave length of 360 nm. The maximum luminance of the thin-film EL device was 200 cd/m$^2$.

EXAMPLE 2

The procedure of Example 1 for preparing a thin-film EL device was repeated except that the buffer layers of ZnS on both sides of the phosphor layer were not provided.

In the excitation spectrum of the phosphor layer of the thin-film EL device thus prepared there was observed a peak at a wavelength of 360 nm.

The maximum luminance of the thin-film EL device observed was 9,000 cd/m$^2$.

EXAMPLE 3

The procedure of Example 1 for preparing a thin-film EL device was repeated except that the buffer layers of ZnS on both sides of the phosphor layer of the thin-film EL device thus prepared was replaced by the buffer layers of SrS.

In the excitation spectrum of the phosphor layer of the thin-film EL device thus prepared there was observed a peak at a wavelength of 361 nm.

The maximum luminance of the thin-film EL device observed was 12,000 cd/m$^2$.

EXAMPLE 4

The procedure of Example 1 for preparing a thin-film EL device was repeated except that the phosphor layer was formed by sputtering in Ar gas instead of an Ar gas containing 2 mol % of hydrogen sulfide.

Figure 5:
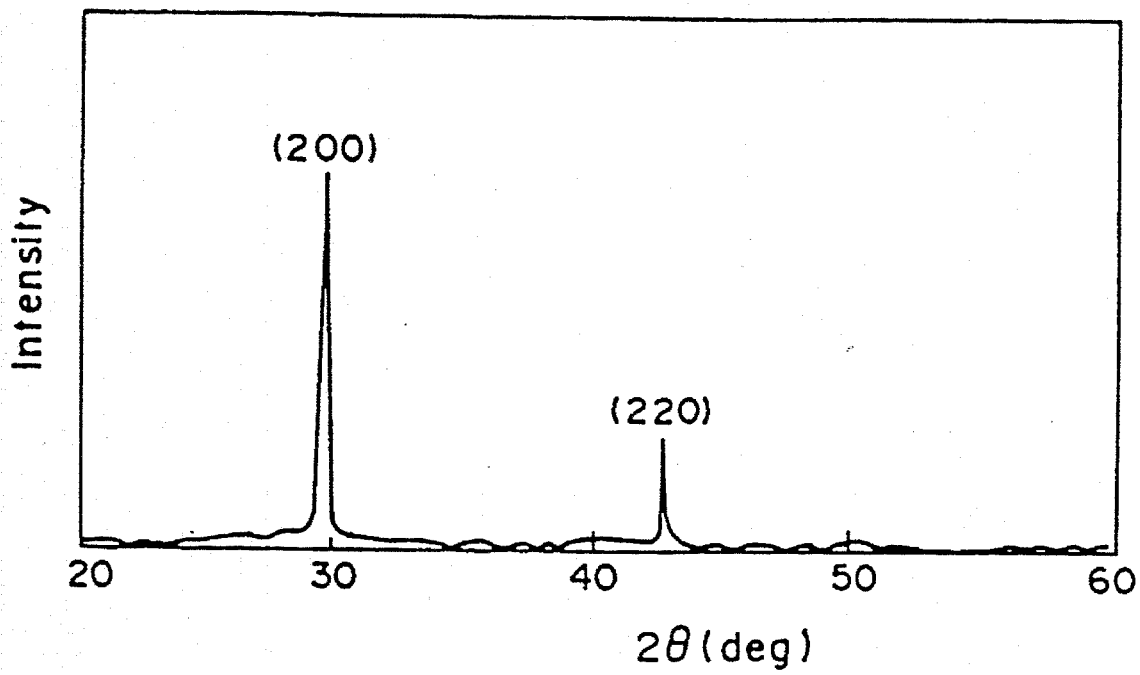
FIG. 5 shows an X-ray diffraction pattern of another embodiment of the SrS:Ce phosphor layers of the present invention.

The X-ray diffraction pattern of the annealed phosphor layer which is shown in FIG. 5, exhibited a (200) orientation. The half width of the peak at the (200) line was 0.3 degrees and that of the peak at (220) line was 0.4 degrees. The excitation spectrum of the annealed phosphor layer exhibited a characteristic peak at a wavelength of 358 nm. The maximum luminance of the thin-film EL device was 12,000 cd/m$^2$.

EXAMPLES 5 TO 14 AND COMPARATIVE EXAMPLES 3 TO 5

The procedure of Example 1 for preparing a thin-film EL device was repeated except that the annealing temperature, the annealing time and the concentration of hydrogen sulfide in the annealing atmosphere as set forth in Table 1 below were employed.

The maximum luminances of the thin-film EL devices thus obtained are shown in Table 1 below.

TABLE 1

| | Annealing Temperature (°C.) | Annealing Time (hour) | Concentration of Hydrogen sulfide (mol %) | Maximum Luminance (cd/m$^2$) |
|---|---|---|---|---|
| Example No. | | | | |
| 5 | 650 | 8 | 10 | 2000 |
| 6 | 650 | 24 | 10 | 2500 |
| 7 | 670 | 12 | 10 | 8500 |
| 8 | 670 | 12 | 20 | 8500 |
| 9 | 720 | 1 | 10 | 3000 |
| 10 | 720 | 2 | 10 | 5000 |
| 11 | 720 | 3 | 10 | 8000 |
| 12 | 720 | 4 | 1 | 9500 |
| 13 | 720 | 12 | 20 | 9800 |
| 14 | 760 | 4 | 20 | 9000 |
| Comperative Example No. | | | | |
| 3 | 600 | 24 | 0 | 300 |
| 4 | 600 | 24 | 10 | 1600 |
| 5 | 720 | 0.5 | 10 | 500 |

EXAMPLE 15

The procedure of Example 1 for preparing a thin-film EL device was prepared except that a phosphor layer was formed by sputtering in Ar gas from a pressed target of mixed powder of SrS, 0.3 mol % of $CeF_3$, 0.3 mol % of $PrF_3$and 0.3 mol % of KCl per mol of SrS.

The excitation spectrum of the phosphor layer of the thin-film EL device thus obtained exhibited a peak at a wavelength of 355 nm. The maximum luminance of the thin-film EL device was 12,000 cd/m$^2$.

EXAMPLE 16

The procedure of Example 1 for preparing a thin-film EL device was repeated except that a phosphor layer was prepared by sputtering from a pressed target of mixed powder of SrS, 0.3 mol % of $CeF_3$, 0.3 mol % of KCl and 0.02 mol % of $EuF_3$ per mol of SrS.

The excitation spectrum of the phosphor layer of the thin-film EL device thus obtained exhibited a peak at a wavelength of 365 nm. The maximum luminance of the thin-film EL device was 7,000 cd/m$^2$.

EXAMPLE 17

The same procedure of Example 1 for preparing a thin-film EL device was repeated except that the phosphor layer was annealed at 680° C. in Ar gas atmosphere containing 1 mol % of carbon disulfide.

The maximum luminance of the thin-film EL device thus obtained was 3,500 cd/m$^2$.

EXAMPLE 18

The procedure of Example 1 for preparing a thin-film EL device was repeated except that a phosphor layer was prepared by sputtering from a pressed target of mixed powder of SrS, 0.3 mol % of $SmF_3$ and 0.3 mol % of KCl per mol of SrS.

The excitation spectrum of the phosphor layer of the thin-film EL device thus obtained exhibited a peak at a wavelength of 359 nm. The maximum luminance of the thin-film device was 400 cd/m$^2$.

EXAMPLES 19 TO 25

The procedure of Example 1 for preparing a thin-film EL device was repeated except that the luminous center as shown in Table 2 below was employed.

The maximum luminances of the thin-film EL devices thus obtained are shown in Table 2 below.

TABLE 2

| Example No. | Luminous Center | Maximum Luminance (cd/m$^2$) |
|---|---|---|
| 19 | Tb | 200 |
| 20 | Tm | 25 |
| 21 | Nd | 290 |
| 22 | Dy | 300 |
| 23 | Ho | 150 |
| 24 | Er | 310 |
| 25 | Cu | 220 |

EXAMPLE 26

The procedure of Example 1 for preparing a thin-film EL device was repeated except that the buffer layer of ZnS, at the side of the aluminum electrode, on the phosphor layer was not provided.

In the excitation spectrum of the phosphor layer of the thin-film EL device thus prepared there was observed a peak at a wavelength of 360 nm.

The maximum luminance of the thin-film EL device observed was 9,600 cd/m$^2$.

EXAMPLE 27

The procedure of Example 1 for preparing a thin-film EL device was repeated except that the buffer layer of ZnS, at the side of the transparent ITO electrode, on the insulating layer was not provided.

In the excitation spectrum of the phosphor layer of the thin-film EL device thus prepared there was observed a peak at a wavelength of 360 nm.

The maximum luminance of the thin-film EL device observed was 9,400 cd/m$^2$.

We claim:

1. A method for preparing a thin-film electroluminescent device comprising the sequential steps of:

(a) forming an electrode on a substrate;

(b) forming a first insulting layer on the electrode;

(c) on the first insulating layer, forming a phosphor layer comprising SrS as a host material and at least one metal selected from a group consisting of Mn, Tb, Tm, Sm, Ce, Eu, Pr, Nd, Dy, Ho, Er and Cu as a luminous center;

(d) annealing the phosphor layer at a temperature of at least 650° C. for at least one hour in an atmosphere of a sulfur-containing gas selected from a group consisting of hydrogen sulfide, carbon disulfide, sulfur vapor, a dialkyl sulfide, thiophene and a mercaptan;

(e) forming a second insulating layer on the annealed phosphor layer; and (f) forming a second electrode on the second insulating layer;

wherein at least one of the first or second electrodes is transparent.

2. The method of claim 1, wherein the phosphor layer is annealed at a temperature from 650° C. to 850° C.

3. The method of claim 1 further comprising the step of:

(g) depositing a first metal sulfide layer selected from the group consisting of ZnS, CdS, SrS, CaS, BaS and CuS as the buffer layer of the first insulating layer.

4. The method of claim 3 additionally comprising the step of:

(h) depositing a second metal sulfide layer selected from the group consisting of ZnS, CdS, SrS, CaS, BaS and CuS as the buffer layer on the annealed phosphor layer.

5. The method of claim 3, wherein the the first and second metal sulfide layers are about from 100 Å to 10,000 Å thick.

6. The method of claim 1, wherein the first and second insulating layers independently comprise at least one compound selected from the group consisting of $SiO_2$, $Y_2O_3$, $TiO_2$, $Al_2O_3$, $HfO_2$, $Ta_2O_5$, $BaTa_2O_5$, $SrTiO_3$, $PbTiO_3$, $Si_3N$ and $ZrO_2$.

7. The method of claim 1, wherein the thickness of the first and second insulating layers is about from 500 Å to 30,000 Å.

8. The method of claim 1, wherein the phosphor layer in step (c) further comprises at least one charge compensator selected from the group consisting of KCl, NaCl and NaF at a concentration of about from 0.01 mol % to 5 mol % per mol of SrS as the host material.

9. The method of claim 1, wherein the concentration of the luminous center is about from 0.01 mol % to 5 mol % per mol of SrS as the host material.

10. The method of claim 1, wherein the thickness of the phosphor layer is about from 500 Å to 30,000 Å.

11. The method of claim 1, wherein the atmosphere contains about from 0.01 mol % to 100 mol % of the sulfur-containing gas and less than or equal to 99.99 mol % of an inert gas.

12. The method of claim 11, wherein the inert gas is Ar.

13. The method of claim 1, wherein the phosphor layer is formed by sputtering in an atmosphere of hydrogen sulfide.

14. A thin-film electroluminescent device having a phosphor layer that exhibits both an x-ray diffraction pattern including a (220) line with a half-width less than or equal to 0.5 degrees and a (200) line with a half width less than or equal to 0.4 degrees and an excitation spectrum with a peak at a wavelength of about from 350 nm to 370 nm, the thin film electroluminescent device manufactured by a method comprising the steps of:

forming a first electrode on a substrate;

forming a first insulating layer on the first electrode;

forming phosphor layer, including a luminous center and charge compensator, on the first insulating layer;

annealing the phosphor layer for at least one hour at a temperature of at least 650° C. in an atmosphere including a sulfur-containing gas;

forming a second insulating layer on the annealed phosphor layer; and forming a second electrode on the second insulating layer, wherein one of the first or second electrodes is transparent.

15. A thin-film electroluminescent device which is obtained by the method of claim 1.

16. The method of claim 1, wherein the first and second electrodes are formed as thin-film electrodes.

17. The method of claim 1, wherein the substrate comprises glass.

18. The method of claim 1, wherein the substrate comprises quartz.

19. The method of claim 4, wherein the thickness of the metal sulfide layers is about from 100 Å to 10,000 Å.

* * * * *

UNITED STATES PATENT AND TRADEMARK OFFICE

CERTIFICATE OF CORRECTION

PATENT NO. : 5,554,449

DATED : September 10, 1996

INVENTOR(S) : Tonomura et al.

It is certified that error appears in the above-indentified patent and that said Letters Patent is hereby corrected as shown below:

Claim 5, col. 11, line 35, delete "the" (second occurrence).

Signed and Sealed this

Twenty-sixth Day of November 1996

*Attest:*

Bruce Lehman

BRUCE LEHMAN

*Attesting Officer*

*Commissioner of Patents and Trademarks*